US009079228B2

(12) United States Patent
Shih et al.

(10) Patent No.: US 9,079,228 B2
(45) Date of Patent: Jul. 14, 2015

(54) METHODOLOGY FOR CLEANING OF SURFACE METAL CONTAMINATION FROM AN UPPER ELECTRODE USED IN A PLASMA CHAMBER

(75) Inventors: Hong Shih, Walnut, CA (US); Armen Avoyan, Glendale, CA (US); Shashank C. Deshmukh, San Ramon, CA (US); David Carman, San Jose, CA (US)

(73) Assignee: Lam Research Corporation, Fremont, CA (US)

( * ) Notice: Subject to any disclaimer, the term of this patent is extended or adjusted under 35 U.S.C. 154(b) by 721 days.

(21) Appl. No.: 12/962,166

(22) Filed: Dec. 7, 2010

(65) Prior Publication Data

US 2011/0146704 A1 Jun. 23, 2011

Related U.S. Application Data

(60) Provisional application No. 61/288,087, filed on Dec. 18, 2009.

(51) Int. Cl.
*B08B 3/08* (2006.01)

(52) U.S. Cl.
CPC ..... *B08B 3/08* (2013.01)

(58) Field of Classification Search
CPC ..... B08B 3/08
See application file for complete search history.

(56) References Cited

U.S. PATENT DOCUMENTS 5,439,569 A * 8/1995 Carpio ..... 134/1.3
5,932,022 A 8/1999 Linn et al.
6,073,577 A 6/2000 Lilleland et al.
6,148,765 A 11/2000 Lilleland et al.
6,194,322 B1 2/2001 Lilleland et al.
6,376,385 B2 4/2002 Lilleland et al.
6,607,605 B2 8/2003 Tan
6,790,289 B2 9/2004 Takase et al.
6,810,887 B2 11/2004 Tan
6,821,350 B2 11/2004 Krogh
6,841,008 B1 1/2005 Branco et al.
6,855,576 B2 2/2005 Yamaguchi et al.
6,897,161 B2 5/2005 Suzuki
7,052,553 B1 5/2006 Shih et al.
7,247,579 B2 7/2007 Ren et al.

(Continued)

FOREIGN PATENT DOCUMENTS

TW 544794 B 8/2003
TW 200610592 A 4/2006

(Continued)

OTHER PUBLICATIONS

Notification of Reasons for Rejection sent Feb. 3, 2015 for Japanese Patent Appln. No. 2012-544473.

(Continued)

*Primary Examiner* — Michael Barr
(74) *Attorney, Agent, or Firm* — Buchanan Ingersoll & Rooney PC

(57) ABSTRACT

A method for cleaning metallic contaminants from an upper electrode used in a plasma chamber. The method comprises a step of soaking the upper electrode in a cleaning solution of concentrated ammonium hydroxide, hydrogen peroxide and water. The cleaning solution is free of hydrofluoric acid and hydrochloric acid. The method further comprises an optional step of soaking the upper electrode in dilute nitric acid and rinsing the cleaned upper electrode.

13 Claims, 2 Drawing Sheets

(56) References Cited

U.S. PATENT DOCUMENTS

| | | | | |
|---|---|---|---|---|
| 7,291,286 | B2 | 11/2007 | Magni et al. | |
| 7,387,964 | B2 | 6/2008 | So et al. | |
| 7,442,114 | B2 | 10/2008 | Huang et al. | |
| 7,498,269 | B2 | 3/2009 | Ren et al. | |
| 7,507,670 | B2 | 3/2009 | Shih et al. | |
| 7,517,803 | B2 | 4/2009 | Ren et al. | |
| 7,578,889 | B2 | 8/2009 | Shih et al. | |
| 7,767,028 | B2 | 8/2010 | Augustino et al. | |
| 8,709,912 | B2 | 4/2014 | Urano et al. | |
| 2002/0189640 | A1* | 12/2002 | Linn et al. | 134/3 |
| 2003/0104680 | A1 | 6/2003 | Stefanescu et al. | |
| 2005/0274396 | A1 | 12/2005 | Shih et al. | |
| 2008/0092920 | A1 | 4/2008 | Shih et al. | |
| 2008/0236620 | A1* | 10/2008 | Shih et al. | 134/9 |
| 2009/0090396 | A1 | 4/2009 | Lee et al. | |

FOREIGN PATENT DOCUMENTS

| | | | |
|---|---|---|---|
| TW | 200802573 | A | 1/2008 |
| TW | 200845195 | A | 11/2008 |
| TW | 200905745 | A | 2/2009 |

OTHER PUBLICATIONS

Partial English translation of Notification of Examination Opinions issued on Mar. 24, 2015, by the Taiwanese Patent Office in corresponding Taiwanese Patent Application No. 099144466. (9 pages).

* cited by examiner

METHODOLOGY FOR CLEANING OF SURFACE METAL CONTAMINATION FROM AN UPPER ELECTRODE USED IN A PLASMA CHAMBER

This application claims priority under 35 U.S.C. §119 to U.S. Provisional Application No. 61/288,087 entitled METHODOLOGY FOR CLEANING OF SURFACE METAL CONTAMINATION FROM AN UPPER ELECTRODE USED IN A PLASMA CHAMBER, filed Dec. 18, 2009, the entire content of which is hereby incorporated by reference.

BACKGROUND

In capacitively coupled plasma (CCP) chambers, integrated circuits are formed from a wafer or substrate over which are formed patterned microelectronics layers. In the processing of the substrate, plasma is generated between upper and lower electrodes and often employed to deposit films on the substrate or to etch intended portions of the films. The chambers exhibit etch rate drop and etch uniformity drift after a large number of radio frequency (RF) hours are run using the electrodes. The decline of etch performance results from changes in the morphology of the silicon surface of the electrodes as well as contamination of plasma exposed surfaces of the electrodes. Thus, there is a need for a systematic and effective methodology to clean the electrodes and reduce surface roughness so that the electrodes meet surface contamination specifications and manufacturing yields are enhanced.

SUMMARY

A method for cleaning metallic contaminants from an upper electrode used in a plasma chamber, includes soaking the entire upper electrode in a cleaning solution consisting of ammonium hydroxide, hydrogen peroxide and water, preferably a concentrated ammonium hydroxide water solution of 28-30 weight % on $NH_3$ basis, hydrogen peroxide water solution of 29-31 weight % and water at a volume ratio from 1-2:1-2:2 to 1-2:1-2:20.

DETAILED DESCRIPTION

Figure 1:
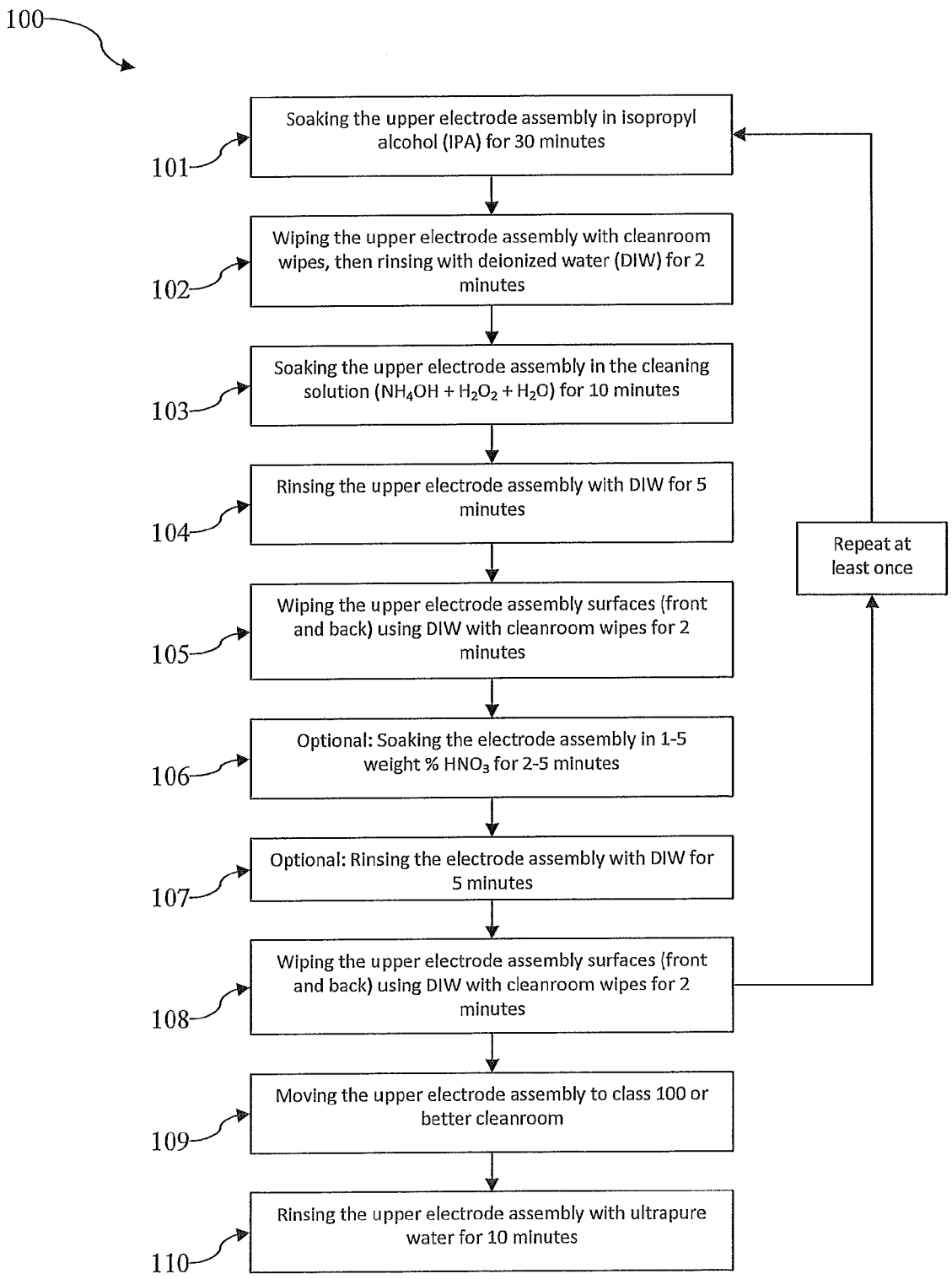
FIG. 1 is a flow chart illustrating exemplary steps to clean an upper electrode in accordance with one embodiment.

An exemplary CCP chamber may include: a chamber wall; an upper electrode having a lower plasma exposed surface; a substrate support; an electrostatic chuck embedded in the substrate support and operative to hold a substrate during processing of the substrate. The wall preferably includes a substrate transfer slot or gate for transferring the substrate into and out of the chamber. The wall may optionally be coated with a suitable wear-resistant material. To provide an electrical path to ground, the wall may be made of metal, such as aluminum, and electrically grounded. The substrate support can comprise an aluminum plate which acts as a lower electrode and is coupled to an RF power supply (typically via a matching network). The upper electrode may be coupled to an RF power source (typically via a matching network) and one or more gas lines for process gas. Other types of circuit arrangements may be used to power the upper electrode and the lower electrode. For instance, the upper electrode may be grounded to provide a return path for power supplied to the lower electrode. Alternatively, the lower electrode may be coupled to two or more RF power supplies having difference frequencies. The upper electrode is spaced apart from the lower electrode, forming a space for generating plasma therebetween. During operation, the upper electrode and/or the lower electrode electrically excite the process gas into plasma.

The upper electrode may be a single-piece electrode or a multi-piece electrode. For example, the upper electrode may include a monolithic showerhead electrode, or it may include an inner showerhead electrode plate and one or more segments forming an annular outer electrode ring. The upper electrode preferably includes a backing member, for example, an aluminum or graphite backing plate. The monolithic showerhead electrode or the inner showerhead electrode plate and outer electrode ring may be optionally bonded to the backing member by a bonding material, such as an elastomer bonding material (elastomeric joint). Details of using an elastomer bonding material in the upper electrode are disclosed in commonly assigned U.S. Pat. Nos. 6,376,385, 6,194,322, 6,148,765, 6,073,577, all of which are hereby incorporated by reference in their entirety. The elastomeric joint allows movement between the electrode and backing member to compensate for thermal expansion as a result of temperature cycling of the upper electrode. The elastomeric joint may include an electrically and/or thermally conductive filler and can be a catalyst-cured polymer that is stable at high temperatures. For example, the elastomeric joint may be formed of silicone polymer and the filler may be formed of aluminum alloy or silicon powder. The upper electrode is preferably formed of single crystalline silicon in order to provide low electrical resistance and minimize electrode contamination. The backing member, elastomeric joint, and showerhead electrode may include a plurality of holes or gas outlets that allow passage of a process gas through the upper electrode. Preferably, the diameters of the holes in the upper electrode are from 600 μm and 1000 μm.

During plasma processing, the upper electrode can be contaminated by metals such as Ca, Cr, Co, Cu, Fe, Li, Mg, Mo, Ni, K, Na, Ti, Zn (e.g. from substrates processed under the upper electrode). During plasma processing, such metals can be liberated from the upper electrode and contaminate the substrate undergoing processing such as plasma etching.

To prevent metal contamination of processed substrates, the upper electrode is periodically taken out of the chamber and cleaned after a certain number of RF hours. Alternatively, the cleaning described herein may be applied as a final stage of manufacture of a new upper electrode. FIG. 1 shows a flow chart 100 illustrating exemplary steps to clean an upper electrode in accordance with one embodiment. In a step 101, the upper electrode is soaked in isopropyl alcohol (IPA) for a suitable time such as 10 minutes to 1 hour, preferably about 30 minutes to remove organic contaminants from the upper electrode. The word "about" as used herein means ±10%.

Figure 2:
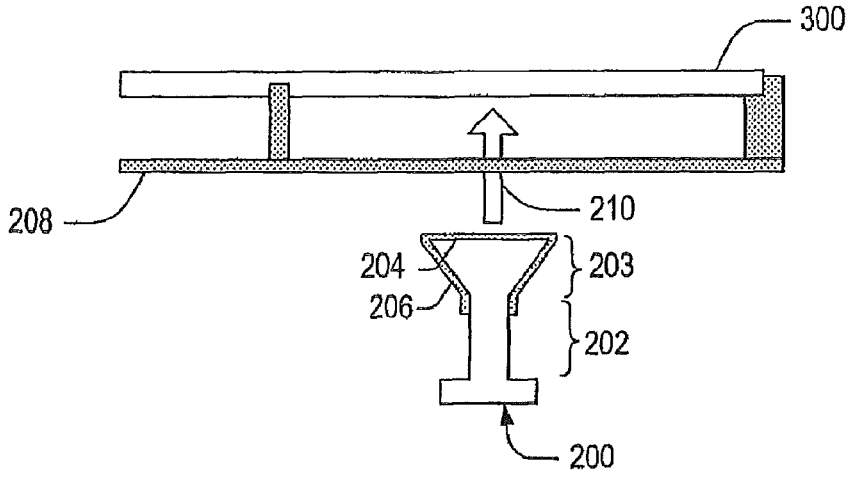
FIG. 2 shows a schematic cross sectional view of a fixture for cleaning an upper electrode in accordance with another embodiment.
Figure 3A:
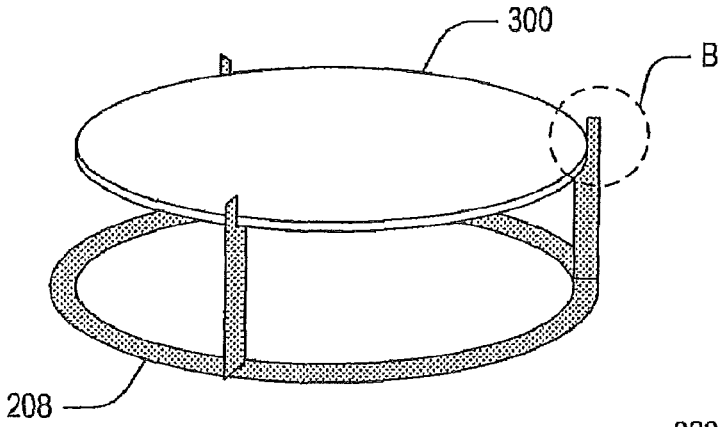
FIG. 3A shows a perspective view of the fixture in FIG. 2.
Figure 3B:
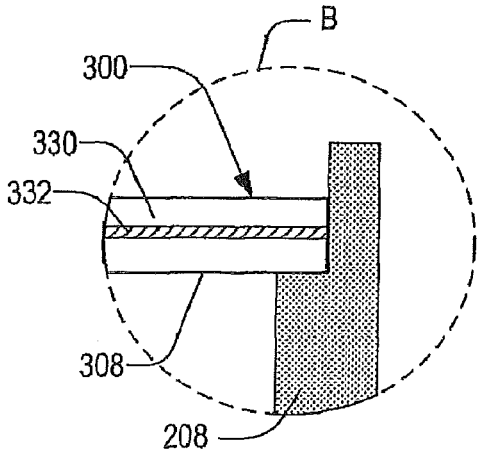
FIG. 3B shows an enlarged cross sectional view of region B in FIG. 3A.

In a step 102, the upper electrode is wiped with cleanroom wipes (such as class-100 acid resistant cleanroom wipes manufactured by VWR LabShop (BataVia, Ill.), which are made of knitted polyester with sealed edges and laundered) and rinsed with deionized water (DIW) for a suitable time such as 1 to 10 minutes, preferable about 2 minutes. FIG. 2 shows a schematic cross sectional view of a fixture 208 on which an upper electrode 300 can be wiped. FIG. 3A shows a perspective view of the fixture 208 supporting the upper electrode 300 and FIG. 3B shows an enlarged schematic cross section view of the region B in FIG. 3A. A wiping tool 200 is preferably formed of Teflon® (polytetrafluoroethylene) and includes a handle portion 202 and a frusto-conical section 203. The frusto-conical section 203 has a flat surface 204 covered with a wipe 206, which, during wiping, can be wetted with cleaning solution such as IPA. A human operator of the wiping tool 200 preferably holds the handle portion 202 and applies an upward force 210 to contact the upward facing flat surface 204 of the wiping tool 200 with the downward facing surface of the upper electrode 300 (e.g. a plasma exposed surface). Further, the fixture 208 may be rotated during wiping.

As shown in FIGS. 2, 3A, and 3B, the fixture 208, sized to the upper electrode 300 to be cleaned, has a sturdy base frame and three or more vertical supporting members that support the upper electrode 300 such that a plasma exposed surface of the upper electrode 300 faces downward. The top of each supporting member preferably has an inner step on which an edge of the upper electrode 300 rests. The steps prevent the upper electrode 300 from slipping off the supporting members during cleaning of the plasma exposed surface. The supporting members and base are preferably coated with and/or made from a chemically resistant material, such as Teflon®.

In a step 103, the upper electrode is soaked in a cleaning solution for a suitable time such as 10 to 60 minutes, preferably at room temperature. The cleaning solution is made by mixing ammonium hydroxide, hydrogen peroxide and water, preferably a concentrated ammonium hydroxide water solution (CAS#1336-21-6) (28-30 weight % on $NH_3$ basis, preferably 29 weight %), a hydrogen peroxide water solution (CAS#7722-84-1) (29-31 weight %, preferably 29 weight %) and water at a volume ratio from 1-2:1-2:2 to 1-2:1-2:20, preferably 1-2:1-2:2 to 1-2:1-2:15, more preferably 1:1:2 to 1:1:10, most preferably 1:1:10.

Hydrogen peroxide in the cleaning solution decomposes into water and atomic oxygen. Atomic oxygen oxidizes metallic contaminants on the upper electrode. Ammonium ions in the cleaning solution can chelate oxidized metallic contaminants and form soluble complexes. For example, Cu contaminants react with the cleaning solution as: $Cu+H_2O_2=CuO+H_2O$; $CuO+4NH_3+H_2O=Cu(NH_3)_4^{2+}+2OH^-$.

In a step 104, the upper electrode is rinsed with DIW for a suitable time such as about 5 minutes to remove any residue of the cleaning solution.

In a step 105, the upper electrode (both front and back) is wiped using DIW soaked cleanroom wipes for a suitable time such as 1 to 10 minutes, preferably about 2 minutes.

In an optional step 106, the upper electrode is soaked in dilute nitric acid solution (CAS#7697-37-2) (1-5 weight %, preferably 2 weight %) for a suitable time such as 1 to 10 minutes, preferably 2 to 5 minutes. Dilute nitric acid is effective to further remove metallic contaminants from the upper electrode.

If the optional step 107 is carried out, it is followed by a step 108 in which the upper electrode is rinsed with DIW for a suitable time such as 1 to 10 minutes, preferably about 5 minutes to remove any residue of the dilute nitric acid.

Steps 101 to 108 can be repeated one or more times.

In a step 109, the upper electrode is moved to a class 100 or better cleanroom.

In a step 110, the upper electrode is rinsed with ultrapure water for a suitable time such as 1 to 30 minutes, preferably about 10 minutes.

This cleaning process can be followed by other conventional cleaning steps.

This cleaning process of the upper electrode does not use mechanical polishing or treatment with hydrofluoric acid, thus prevents excessive wear and damage to the elastomeric joint. This cleaning process is effective to remove copper and other metal contamination from both easily accessible surfaces and other surfaces such as surfaces in screw holes, gas passages or the like.

TABLE 1

| Metal | Amount before cleaning ($10^{10}$ atoms/cm$^2$) | Amount after cleaning ($10^{10}$ atoms/cm$^2$) |
|---|---|---|
| Al | 1300 | 20 |
| Ca | 760 | 390 |
| Cr | 1.8 | <0.2 |
| Co | 3.8 | 0.1 |
| Cu | 3200 | 35 |
| Fe | 57 | 4.4 |
| Li | 13 | <0.9 |
| Mg | 58 | 16 |
| Mo | 0.22 | <0.09 |
| Ni | 210 | 2.0 |
| K | 460 | 4.8 |
| Na | 1600 | 40 |
| Ti | 77 | 2.4 |
| Zn | 290 | 65 |

Table 1 shows elemental analysis on a plasma exposed surface of a silicon showerhead electrode before and after cleaning.

A human operator preferably wears gloves during performance of the cleaning process described herein and handling the upper electrode between the steps to prevent organic contamination from human contact. Also, whenever necessary, the human operator can put on new gloves to prevent contaminants or particles generated in one step from being transferred to the upper electrode in subsequent steps.

While the cleaning method and the cleaning solution have been described in detail with reference to specific embodiments thereof, it will be apparent to those skilled in the art that various changes and modifications can be made, and equivalents employed, without departing from the scope of the appended claims.

We claim:

1. A method for cleaning metallic contaminants from an upper electrode used in a plasma chamber by a cleaning process, comprising:

soaking the entire upper electrode in a cleaning solution comprising ammonium hydroxide, hydrogen peroxide and water for a time suitable to remove metallic contaminants;

wherein the method does not include treatment of the upper electrode with hydrofluoric acid.

2. The method of claim 1, wherein the upper electrode is soaked in the cleaning solution for 10 to 60 minutes.

3. The method of claim 1, further comprising:

before soaking in the cleaning solution, soaking the upper electrode in isopropyl alcohol for about 30 minutes;

wiping the upper electrode with cleanroom wipes and rinsing the upper electrode with deionized water for about 2 minutes; and after soaking in the cleaning solution, rinsing the upper electrode with deionized water for about 5 minutes;

wiping the upper electrode using deionized water with cleanroom wipes for about 2 minutes;

optionally soaking the upper electrode in a 2% nitric acid solution for 2 to 5 minutes and rinsing the upper electrode with deionized water for about 1 to 10 minutes.

4. The method of claim 3, further comprising repeating the soaking, wiping and/or rinsing at least once followed by rinsing the upper electrode with ultrapure water for about 1 to 30 minutes.

5. The method of claim 1, wherein the cleaning solution is prepared by mixing a concentrated ammonium hydroxide water solution of 28-30 weight %, hydrogen peroxide water solution of 29-31 weight % and water at a volume ratio of ammonium hydroxide:hydrogen peroxide:water from 1-2:1-2:2 to 1-2:1-2:20.

6. The method of claim 5, wherein the volume ratio is from 1:1:2 to 1:1:10.

7. The method of claim 1, wherein the upper electrode comprises a showerhead electrode of single crystalline silicon.

8. The method of claim 1, wherein the cleaning solution is free of hydrochloric acid.

9. The method of claim 1, wherein the cleaning is carried out without polishing a plasma exposed surface of the upper electrode.

10. The method claim 1, wherein the cleaning is carried out in a class 100 or better cleanroom.

11. The method of claim 1, wherein the upper electrode comprises an aluminum or graphite backing member bonded to a silicon showerhead electrode by an elastomeric joint.

12. The method of claim 1, further comprising removing the upper electrode from a plasma chamber prior to cleaning and reinstalling the cleaned upper electrode in the same or different chamber.

13. The method of claim 1, wherein the cleaning solution: (a) reduces Cu contamination from over $3000\times10^{10}$ atoms/$cm^2$ to less than $50\times10^{10}$ atoms/$cm^2$; (b) reduces Ni contamination from over $200\times10^{10}$ atoms/$cm^2$ to less than $5\times10^{10}$ atoms/$cm^2$; (c) reduces Zn contamination from over $250\times10^{10}$ atoms/$cm^2$ to less than $75\times10^{10}$ atoms/$cm^2$; (d) reduces Fe contamination from over $50\times10^{10}$ atoms/$cm^2$ to less than $5\times10^{10}$ atoms/$cm^2$; (e) reduces Ca contamination from over $700\times10^{10}$ atoms/$cm^2$ to less than $400\times10^{10}$ atoms/$cm^2$; (f) reduces Mg contamination from over $50\times10^{10}$ atoms/$cm^2$ to less than $20\times10^{10}$ atoms/$cm^2$; (g) reduces K contamination from over $450\times10^{10}$ atoms/$cm^2$ to less than $5\times10^{10}$ atoms/$cm^2$; (h) reduces Na contamination from over $1500\times10^{10}$ atoms/$cm^2$ to less than $50\times10^{10}$ atoms/$cm^2$; and (i) reduces Ti contamination from over $250\times10^{10}$ atoms/$cm^2$ to less than $75\times10^{10}$ atoms/$cm^2$.

* * * * *